United States Patent [19]

Joshi

[11] Patent Number: 5,062,474

[45] **Date of Patent: * Nov. 5, 1991**

[54] OIL COOLER

[75] Inventor: Shrikant M. Joshi, Getzville, N.Y.

[73] Assignee: General Motors Corporation, Detroit, Mich.

[ * ] Notice: The portion of the term of this patent subsequent to Aug. 7, 2007 has been disclaimed.

[21] Appl. No.: 638,972

[22] Filed: Jan. 8, 1991

Related U.S. Application Data

[63] Continuation-in-part of Ser. No. 527,459, May 23, 1990, abandoned, which is a continuation-in-part of Ser. No. 470,504, Jan. 26, 1990, Pat. No. 4,945,981.

[51] Int. Cl.[5] ..... F28F 13/12

[52] U.S. Cl. ..... 165/109.1; 165/154; 165/916

[58] Field of Search ..... 165/109.17, 154, 141, 165/916

[56] References Cited

U.S. PATENT DOCUMENTS

| | | | |
|---|---|---|---|
| 2,136,641 | 12/1936 | Smith | 257/263 |
| 2,485,088 | 10/1949 | Ellis | 257/246 |
| 3,197,975 | 8/1965 | Boling | 62/498 |
| 3,473,348 | 10/1969 | Bottum | 62/513 |
| 3,831,247 | 8/1974 | Degroote | 29/157.3 |
| 4,096,616 | 6/1978 | Coffinberry | 29/157.3 |
| 4,373,578 | 2/1983 | Saperstein et al. | 165/141 |
| 4,475,584 | 10/1984 | Martin et al. | 165/26 |
| 4,804,041 | 2/1989 | Hasegawa et al. | 165/166 |
| 4,893,670 | 1/1990 | Joshi et al. | 165/40 |
| 4,945,981 | 8/1990 | Joshi | 165/109.1 |

FOREIGN PATENT DOCUMENTS

| | | | |
|---|---|---|---|
| 644028 | 7/1962 | Canada | 165/154 |
| 645280 | of 1937 | Fed. Rep. of Germany . | |
| 2413250 | of 1975 | Fed. Rep. of Germany . | |
| 2614687 | 11/1988 | France | 165/916 |
| 56-37489 | 4/1981 | Japan | 165/916 |
| 58-33091 | of 1983 | Japan . | |
| 59-56088 | of 1984 | Japan . | |
| 1-46588 | 2/1989 | Japan | 165/154 |
| WO85/04002 | of 1985 | PCT Int'l Appl. . | |

*Primary Examiner*—Allen J. Flanigan

*Attorney, Agent, or Firm*—Ronald L. Phillips

[57] ABSTRACT

A transmission oil cooler has spaced elongated plates secured at the margins and ports at either end to define an oil flow channel. A center disposed between the plates for creating turbulence in the oil and enhancing heat transfer comprises a metal sheet folded to form generally planar fins in side-by-side relationship and the fins having louvers extending over most of their area. The center is disposed in the flow channel with the planes of the fins transverse to the oil flow or alternatively with the planes of the fins parallel to the oil flow.

2 Claims, 4 Drawing Sheets

FIG 1
PRIOR
ART
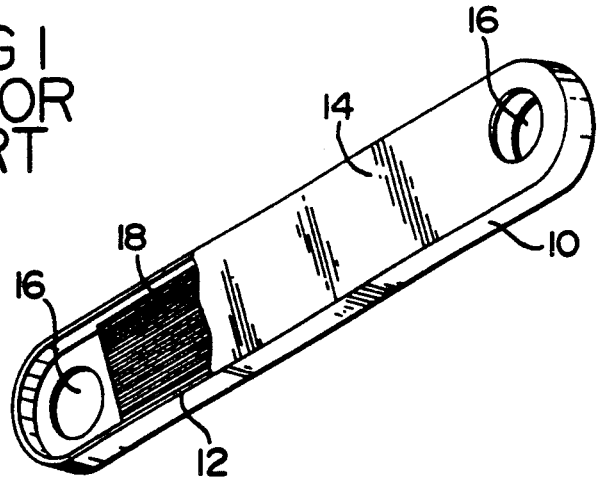
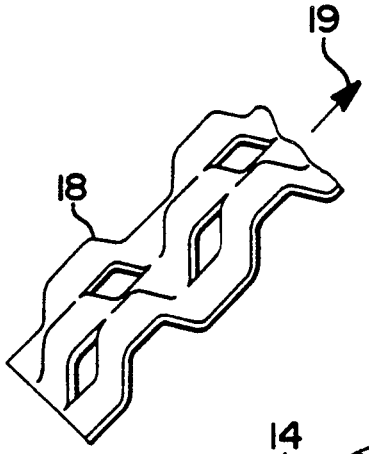
FIG 2
PRIOR
ART
FIG 3
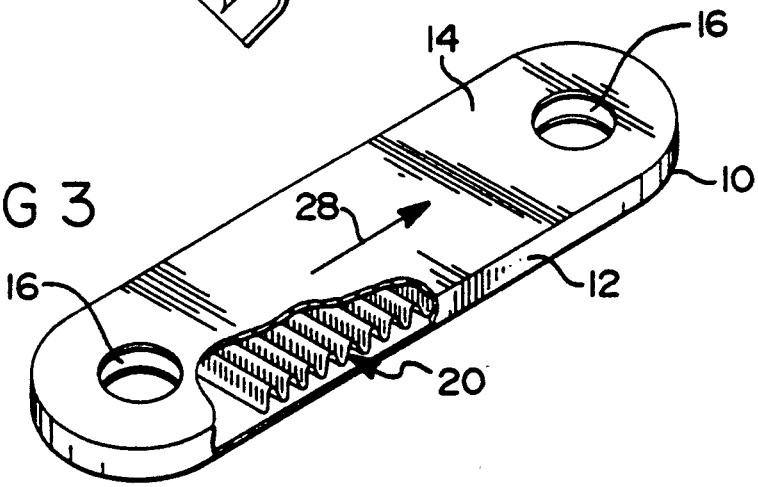
FIG 4
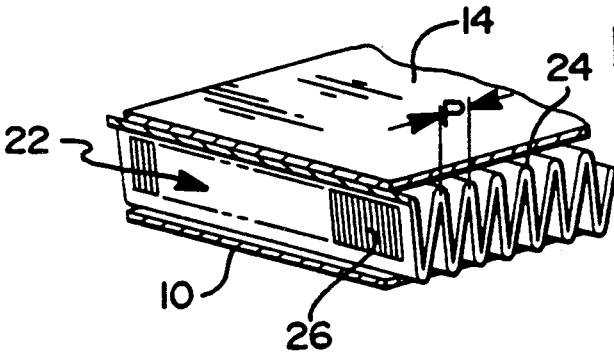

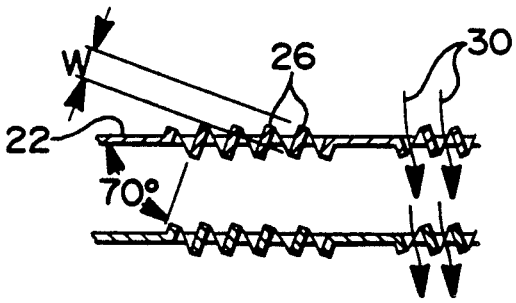
FIG 5
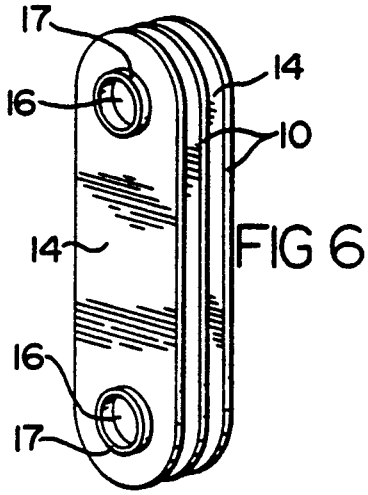
FIG 6
FIG 7
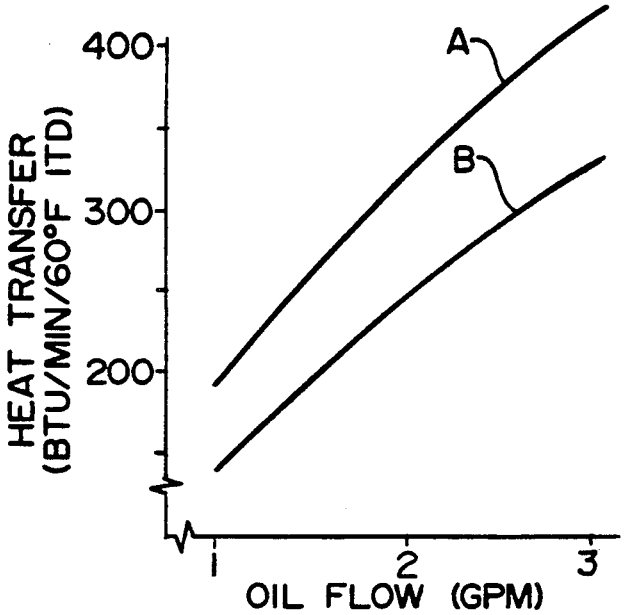
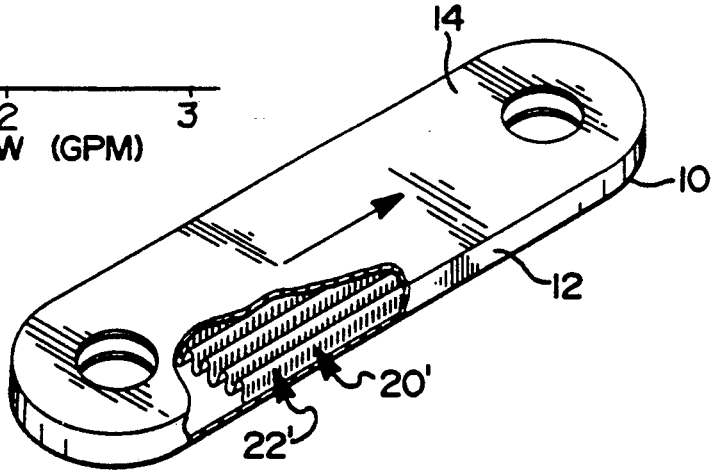
FIG 8
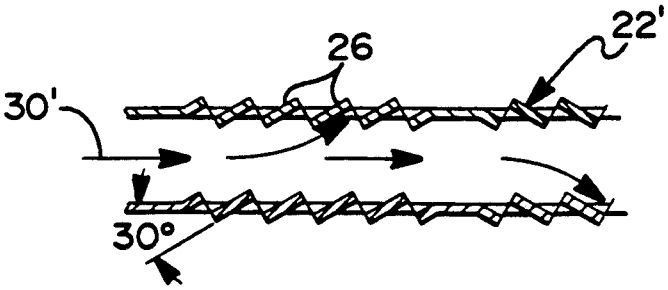
FIG 9

OIL COOLER

This is a continuation-in-part of U.S. patent application Ser. No. 07/527,459 filed May 23, 1990, now abandoned, which is a continuation-in-part of U.S. patent application Ser. No. 07/470,504 filed Jan. 26, 1990, now U.S. Pat. No. 4,945,981.

FIELD OF THE INVENTION

This invention relates to oil coolers and particularly to oil coolers having centers for high efficiency heat transfer.

BACKGROUND OF THE INVENTION

Transmission oil coolers for automotive vehicles are often installed in the vehicle radiator so that the engine coolant flows over the oil cooler and heat is transferred from the transmission oil to the engine coolant. The oil cooler should be characterized by compactness to fit within the tank of a radiator, low resistance to oil flow, strength to contain the pressure of the transmission oil, and high efficiency of heat transfer. The heat transfer efficiency and size are related since a smaller unit may be used for a given thermal transfer requirement if the efficiency is increased.

Heretofore, oil coolers have used a plate type heat exchanger comprising at least one pair of spaced plates secured together at their margins to define a passageway which contains the oil flow and has a conductive insert or center to enhance the heat transfer. Such a prior art device is shown in FIG. 1 and includes a female strip 10 with upstanding side margins 12 and a cooperating male strip 14 secured to the side margins 12 to form an elongated enclosure. A port 16 at each end of the assembly allow oil flow in one port, through the enclosure and out of the other port. A center 18, best shown in FIG. 2, comprises a stamped metal foil formed into staggered step-like undulations. The stamped foil is brazed to the plates or strips 10 and 14. The passageway between the plates is then configured by the center 18 into a plurality of meandering flow paths having a combined resultant flow in the direction shown by the arrow 19. The center 18 causes turbulence which enhances heat transfer and conducts heat from the oil to the plates 10, 14, thereby improving efficiency over a plain plate pair without a center 18.

Other types of heat exchangers have used other kinds of centers. Scarselleta U.S. Pat. No. 4,693,307 shows a center design used in tube and fin heat exchangers suitable for automotive radiators. In that patent a radiator design is disclosed wherein a corrugated sheet formed into a plurality of side-by side fins is sandwiched between flat tubes carrying engine coolant, with the fins being used to dissipate heat from the tubes to the air which flows through the fins. A conventional multilouver fin is shown in FIG. 11 of Scarselletta which has louvers struck out of the plane of each fin and the louvers cover most of the fin area. Other fin designs shown in that patent are the hybrid fin variety which alternates plain fin surface with louvered areas.

The heat exchanger designs for radiators, do not directly apply to oil coolers because of differing constraints on size, corrosion resistance, pressure and thermal capacity. Thus different materials are used and the fin heights are different. To obtain the pressure capability and corrosion resistance for oil coolers, steel centers are used rather than aluminum which is commonly used for radiators and the center height is much less for the steel due to the lower heat conductivity of steel. Thus a number of design considerations require independent designs for radiators and oil coolers.

SUMMARY OF THE INVENTION

It is therefore an object of the invention to further improve the thermal transfer efficiency of oil coolers.

The invention is carried out by a pair of spaced plates secured at their margin to form a flow passage, and a center between the plates having louvered fins. The invention also comprises aligning the center in the passage so that the planes of the fins are transverse to the flow direction.

BRIEF DESCRIPTION OF THE DRAWINGS

The above and other advantages of the invention will become more apparent from the following description taken in conjunction with the accompanying drawings wherein like references refer to like parts and wherein:

FIG. 1 is a partly broken away view of a prior art oil cooler,

FIG. 2 is a detail view of a center for the cooler of FIG. 1,

FIG. 3 is a partly broken away isometric view of an oil cooler according to the invention, FIG. 4 is a partly broken away enlarged segment of the oil cooler of FIG. 3, FIG. 5 is a sectional view of a portion of the oil center of FIG. 3, FIG. 6 is an assembly of plate pairs forming a larger cooler according to the invention, FIG. 7 is a graph of heat transfer comparing the efficiency of the cooler according to the invention with the prior art cooler, FIG. 8 is a partly broken away isometric view of an oil cooler according to another embodiment of the invention, FIG. 9 is a sectional view of a portion of the oil center of FIG. 8.

DESCRIPTION OF THE INVENTION

Figure 10:
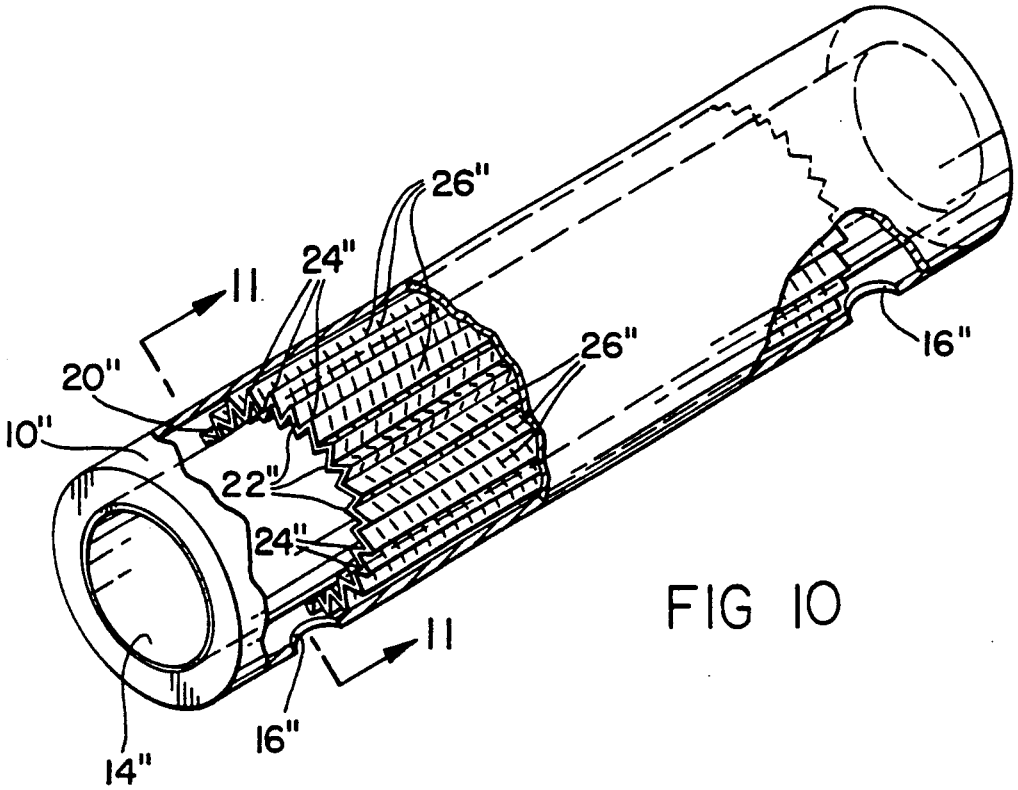
FIG. 10 is a partly broken away isometric view of a tubular type oil cooler according to another embodiment of the invention.

The heat exchanger described herein has been specifically developed as a transmission oil cooler for incorporation in the tank of an automotive radiator. Significant gains in efficiency have been experienced relative to the conventional oil cooler of FIGS. 1 and 2. The prior art oil center is limited by manufacturability to a low density of fins per inch, The new oil center described herein can have a density 2.5 times greater than the prior art center, thus enhancing the surface area and the heat transfer capacity.

Referring to FIG. 3, the oil cooler according to the invention comprises an elongated female plate 10 having upwardly turned margins 12 and a mating male plate 14 secured to the margin in fluid tight relationship and inlet and outlet ports 16 in either end of the plates as in the prior art configuration of FIG. 1. A center 20 is sandwiched between the plates 10, 14 and brazed to the plates to assure mechanical strength of the assembly and excellent thermal coupling of the center and the plates. The center 20, as best shown in FIG. 4, comprises a corrugated or folded sheet of foil forming generally planar fins 22 in side-by-side relationship and joined by bends 24. Each of the fins 22 has a set of louvers 26 extending over most of the fin area. The fins 22 extend transverse to the direction of oil flow as indicated by the arrow 28 in FIG. 3. All the oil must then flow through the louvers 26 of each fin to pass from the inlet to the outlet.

FIG. 5 illustrates a pair of neighboring fins in cross section and the oil flow shown by flow lines 30 passing through the louvers. The louvers 26 must then be sufficiently open to permit flow without undue restriction. To accommodate free flow but still creating turbulence, the louvers are turned from the plane of the fin by an angle on the order of 70°. Preferably the louvers are arranged in groups with several louvers, say, 4 to 10, per group with neighboring groups angled in opposite directions. A specific structure according to the invention used mild steel center material about 0.05 to 0.15 mm thick formed into fins having a pitch p (FIG. 4) of about 1.7 mm and having a peak-to peak height of about 3.4 mm. The louvers each have a width w (FIG. 5) of about 1.14 mm.

The single plate pair of FIG. 3 may be used as a cooler or several plate pairs may be stacked up and joined at their ports 16 to form a cooler as shown in FIG. 6. Such a cooler using four plate pairs yielded the heat transfer results shown in FIG. 7. The upper curve A shows the heat transfer at different oil flow rates for the FIG. 3 design while curve B is the corresponding results for the prior art oil center of FIGS. 1 and 2. The vast improvement enables fewer plates to be used in a cooler to obtain comparable cooling or to use the same size cooler to obtain better cooling. In vehicle testing, a transmission oil cooler according to the invention operated at vehicle speeds of 50 mph resulted in a transmission sump temperature 18° F. cooler than the prior art cooler under the same conditions. This transverse center design is particularly adapted to use at low flow rates since it causes turbulence in the flow to aid in heat transfer. Thus coolers with flow rates yielding low Reynolds numbers and tending to give laminar flow benefit from the transverse center design.

Another embodiment of the invention is shown in FIG. 8 which is similar to FIG. 3 except that the center 20' is oriented with the fins 22, extending parallel to the general direction of oil flow. That is, the center comprises a sheet folded to form generally planar fins in side-by-side relationship and joined at bends like that shown in FIG. 4 and the fin size and pitch and louver size is the same as in the FIGS. 3–5 embodiment. The oil flow generally parallel to the plane of the fins is displayed by flow lines 30' in FIG. 9 which is a cross section of the fins 22'. Thus the primary flow is not through the louvers but some oil does pass through the louvers 26', to cause turbulence and prevent the occurrence of a boundary layer along the fins. Since the oil flow is different from the FIG. 3 embodiment, the louver angle is selected to optimize the heat transfer and oil flow characteristics. With the flow parallel to the plane of the fins, the preferred angle is on the order of 30°. This structure has heat transfer efficiency comparable to the FIG. 3 embodiment. This parallel center design is advantageous at high flow rates which yield high Reynolds numbers. At such high flow rates the flow is turbulent and little heat transfer advantage would be gained by using the transverse centers which create more turbulence and which also have a higher pressure drop than the parallel centers.

Figure 11:
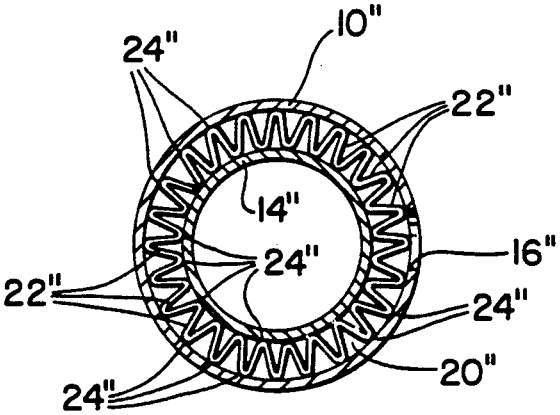
FIG. 11 is a cross sectional view taken on the line 11—11 in FIG. 10.

Another embodiment of the invention in FIGS. 10 and 11 which is similar to FIG. 8 except that the oil cooler plates 10'' and 14'' are tubular members and concentrically arranged and secured at their adjoining ends and the inlet and outlet ports 16'' are only in the outer tubular member 10'' adjacent its respective ends. The center 20'' is oriented like in FIG. 8 with the fins 22'' extending parallel to the general direction of flow in the annulus defined by the tubular members 10'' and 14'' between the spaced ports 16''. That is, the center comprises a sheet folded to form generally planar fins in side-by-side relationship and joined at bend 24'' like that shown in FIG. 8 but in addition the fins are angularly spaced around the outer diameter of the tubular male member and the inner diameter of the tubular female member with the bends contacting the respective tubular members. Thus, the oil flow remains generally parallel to the plane of the fins like in FIG. 9 with the angle of the louvers 26'' selected to allow some oil to pass through the fins to cause turbulence and prevent the occurrence of a boundary layer therealong.

Figure 12:
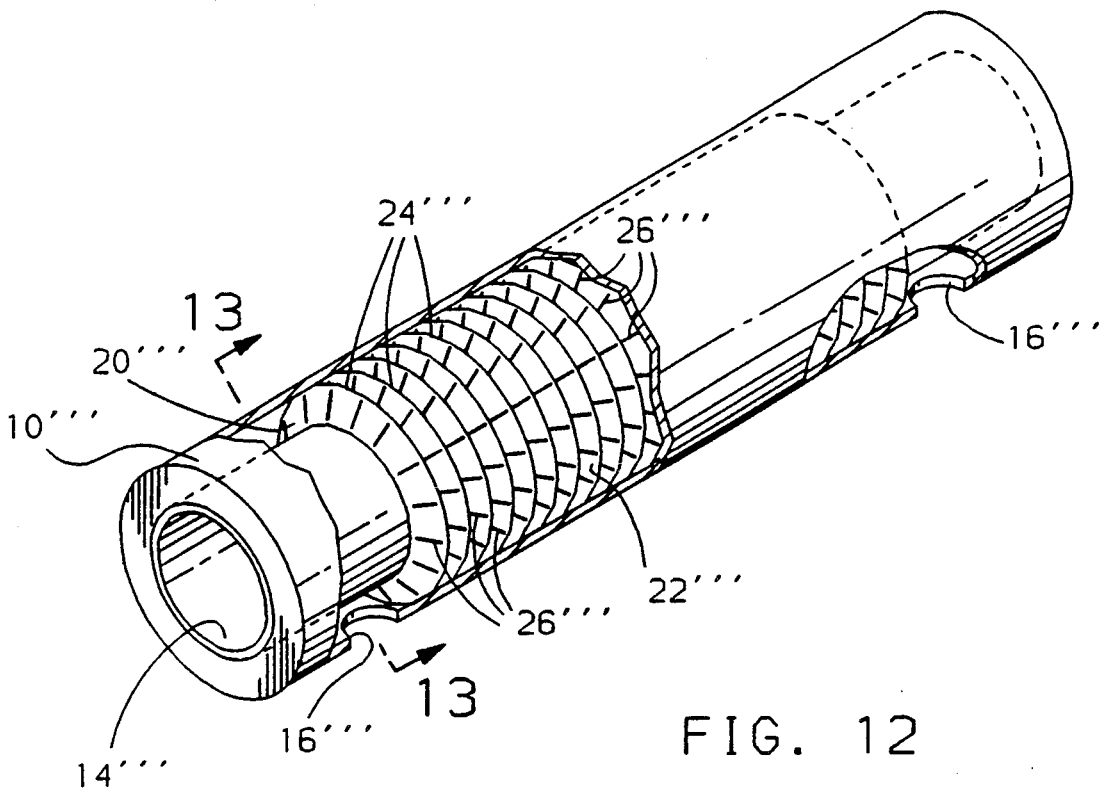
FIG. 12 is a view like FIG. 10 but of another tubular type embodiment of the invention.
Figure 13:
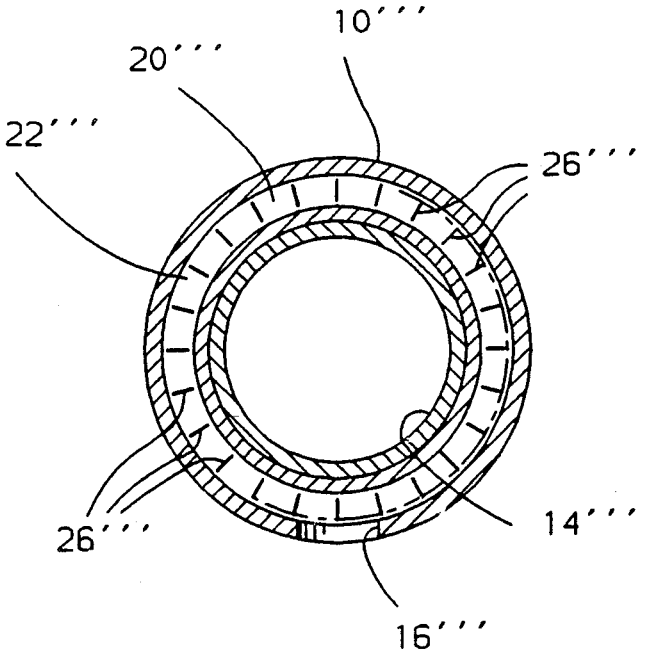
FIG. 13 is a cross sectional view taken on the line 13—13 in FIG. 12.

Alternatively, the oil center can be disposed between the tubular members with the directions of the fin planes transverse to the general direction of flow as shown in FIGS. 12 and 13 and like in the FIG. 3 embodiment so that the oil passes through the openings in the fins. Like before, the tubular oil cooler members 10'' and 14'' are concentrically arranged and secured at their adjoining ends with the inlet and outlet ports 16'' both in the outer tubular member adjacent its respective ends. The oil center 20''' is disposed between the tubular members with its corrugations or fins 22''' transverse to their axis and the general direction of liquid flow between the ports 16'''. As a result, all the oil must flow through the louvers 26''' in these fins to pass from the inlet to the outlet like in the FIG. 3 embodiment. And again, in this case, the louvers project from the fin planes at about the preferred angle of 70° to obtain best results. The oil centers 20''' may be formed in various ways such as from two piece (180°) stampings or a one piece hydroformed part after the manner of U.S. Pat. No. 4,761,982. In both cases, the corrugations 24''' are formed by dies and the louvers 26''' are later formed or added by piercing or slitting the fins in a secondary operation using conventional type piercing and slitting tooling in a radially and/or axially directed manner and at an angle to the fin planes to produce the desired louver angle (preferably about 70° with this direction of flow as described earlier).

The foregoing description of the preferred embodiments of the invention have been presented for purposes of illustration and description. It is not intended to be exhaustive or to limit the invention to the precise forms disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. An oil cooler for transferring heat from oil within the cooler to fluid without the cooler, comprising:

a pair of tubular members secured together at their ends and concentrically arranged to form an oil flow path therebetween, inlet and outlet ports in one of said members to define the general direction of oil flow, an oil center between the tubular members in thermal contact with the tubular members and in the oil flow path for transferring heat from the oil to the tubular members, the oil center comprising a corrugated metal sheet having a plurality of substantially plane fins in side-by-side relationship and joined at bends wherein the bends make the thermal contact with the tubular members, a plurality of louvers in each fin for creating turbulence in the oil flow and defining openings in the fins, and the oil center being disposed with the direction of the fin planes transverse to the general direction of flow so that the oil passes through the openings in the fins in passing from the inlet port to the outlet port.

2. The invention as defined in claim 1 wherein the louvers project from the fin planes at an angle on the order of 70°.

* * * * *